United States Patent [19]

Mihara et al.

[11] 4,362,813

[45] Dec. 7, 1982

[54] SILVER HALIDE PHOTOGRAPHIC EMULSIONS

[75] Inventors: Yuji Mihara; Tadashi Ikeda; Haruo Takei; Masaki Okazaki; Yasuo Aotsuka, all of Kanagawa, Japan

[73] Assignee: Fuji Photo Film Co., Ltd., Kanagawa, Japan

[21] Appl. No.: 278,031

[22] Filed: Jun. 29, 1981

[30] Foreign Application Priority Data

Jun. 30, 1980 [JP] Japan ..... 55-89618

[51] Int. Cl.[3] ..... G03C 1/40; G03C 1/18

[52] U.S. Cl. ..... 430/550; 430/554; 430/555; 430/574

[58] Field of Search ..... 430/574, 550, 554, 555

[56] References Cited

U.S. PATENT DOCUMENTS

| | | | |
|---|---|---|---|
| 3,397,060 | 8/1968 | Schwan et al. | 430/574 |
| 3,580,724 | 5/1971 | Sato et al. | 430/550 |
| 3,729,319 | 4/1973 | Jefferson et al. | 430/574 |
| 3,832,189 | 8/1974 | Shiba et al. | 430/574 |
| 3,854,955 | 12/1974 | Shiba et al. | 430/550 |
| 3,953,215 | 4/1976 | Hinata et al. | 430/574 |

*Primary Examiner*—J. Travis Brown

*Attorney, Agent, or Firm*—Sughrue, Mion, Zinn, Macpeak & Seas

[57] ABSTRACT

A light-sensitive silver halide photographic emulsion characterized by containing a combination of at least one sensitizing dye represented by formula (I) and at least one sensitizing dye represented by formula (II).

(I)

$(X)_{n-1}$ (II)

$(X_1)_{m-1}$

A silver halide color photographic light-sensitive element comprising a support having thereon at least one light-sensitive emulsion layer comprising a sensitizing dye represented by formula (I) and a sensitizing dye represented by formula (II) is also described.

30 Claims, No Drawings

SILVER HALIDE PHOTOGRAPHIC EMULSIONS

BACKGROUND OF THE INVENTION

The present invention relates to a silver halide photographic emulsion which is spectral-sensitized with at least two sensitizing dyes exhibiting supersensitization. More particularly, it relates to a silver halide photographic emulsion having increased spectral sensitivity, particularly in the green-sensitive region.

It is well known in the art that spectral sensitization (i.e., a technique to extend the light-sensitive wavelength region of a silver halide photographic emulsion to longer wavelength regions by adding thereto certain cyanine dye) is applied in the production of photographic light-sensitive elements. It is also known that the sensitivity is enhanced by spectral sensitization, i.e., spectral sensitivity is affected by the chemical structure of sensitizing dyes and various properties of an emulsion, e.g., the halogen composition, crystal habit and crystal system of silver halide, a silver ion concentration, and a hydrogen ion concentration. Furthermore, the spectral sensitivity is affected by photographic additives, such as a stabilizer, an antifoggant, an auxiliary coating agent, a precipitating agent, a color coupler, and a film hardener, which are present in the emulsion.

In general, one sensitizing dye is used to increase the spectral sensitivity of light-sensitive elements. When two or more sensitizing dyes are used in combination with each other, the spectral sensitivity is, in many cases, lower than those obtained using such sensitizing dyes singly. In specific cases, however, the spectral sensitivity can be greatly increased by using certain sensitizing dyes in combination with one or more sensitizing dyes. This phenomenon is known in the art as "supersensitization". Sensitizing dyes which can be used in combination with each other to obtain supersensitization have significant selectivity; that is, an apparently small distinction in the chemical structure exerts very large adverse influences on the supersensitization. Thus, combinations of sensitizing dyes which exhibit the supersenitization action could not be expected by merely observing the chemical structures thereof.

Furthermore, the sensitization of certain emulsions can be changed by changing the state of the emulsion. For example, the sensitization can be enhanced by increasing the silver ion concentration, decreasing the hydrogen ion concentration, or by performing both procedures in combination with each other. Therefore, the sensitization can be enhanced by soaking a film on which a spectral-sensitized emulsion has been coated in water or an aqueous solution of ammonia.

The foregoing method to change the sensitivity of a spectral-sensitized emulsion by increasing the silver ion concentration, decreasing the hydrogen ion concentration or by performing both procedures in combination with each other is usually called "hypersensitization". Emulsions subjected to the hypersensitization generally have poor storage stability.

Sensitizing dyes for use in the supersensitization of silver halide photographic emulsions need not undergo undesirable interaction with color couplers and other photographic additives and furthermore to have stable photographic characteristics during the storage of light-sensitive elements. It is also necessary that these sensitizing dyes leave no residual color in the light-sensitive element after processing. This is particularly necessary in rapid processing wherein the processing is performed in short periods of time (usually, several seconds to several ten seconds). Furthermore, these sensitizing dyes must reduce the fog density.

Combinations of sensitizing dyes which permit the supersensitization, in particular, of the green-sensitive region are known, as described in U.S. Pat. Nos. 3,580,724, 3,729,319 and 3,397,060, etc. These known combinations, however, fail to provide light-sensitive elements which have high green-sensitivity, permit a reduction in fog density and the residual color after processing, and which have good storage stability.

SUMMARY OF THE INVENTION

An object of the invention is to provide a spectral-sensitized silver halide photographic emulsion having high green-sensitivity.

Another object of the invention is to provide a spectral-sensitized silver halide photographic emulsion which has a high sensitivity, and which allows for a reduction in fog density and residual color.

A further object of the invention is to provide a spectral-sensitized silver halide photographic emulsion whose photographic characteristics, such as sensitivity and fog, change less during storage.

Still another object of the invention is to provide a method of reducing a decrease in sensitivity which results from the use of a magenta coupler.

It has been found that the objects are attained by using at least one sensitizing dye represented by formula (I) and at least one sensitizing dye represented by formula (II) in combination with each other.

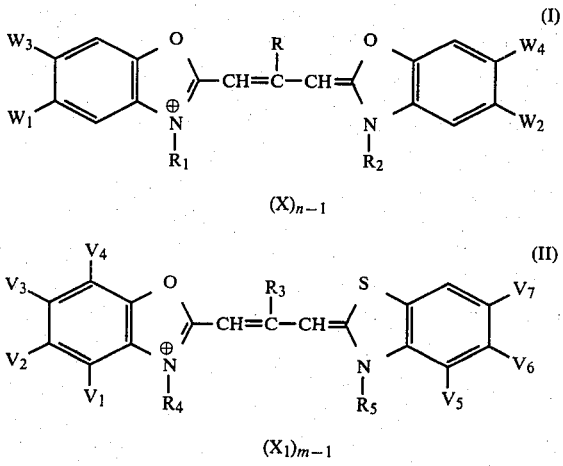

The invention, therefore, relates to a light-sensitive silver halide photographic emulsion containing therein at least one sensitizing dye represented by formula (I) above and at least one sensitizing dye represented by formula (II) above.

DETAILED DESCRIPTION OF THE INVENTION

Sensitizing dyes represented by formulae (I) and (II) will be explained in detail.

In formula (I):

$R_1$ and $R_2$ are independently a substituted or unsubstituted alkyl group, and at least one of $R_1$ and $R_2$ is a sulfoalkyl group or a carboxyalkyl group;

R is an alkyl group or an aralkyl group;

$W_1$, $W_2$, $W_3$ and $W_4$ are independently a hydrogen atom, a halogen atom, an aryl group, an alkyl group, a substituted alkyl group, an alkoxy group, an alkoxycarbonyl group, a carboxy group, or a hydroxy group, but $W_1$ and $W_2$ are not phenyl groups at the same time;

X is an acid anion; and n is 1 or 2, and when the sensitizing dye forms an intramolecular salt (similar to the structure of betaines), n is 1.

In formula (II):

$R_4$ and $R_5$ are independently a substituted or unsubstituted alkyl group, and at least one of $R_4$ and $R_5$ is a sulfoalkyl group or a carboxyalkyl group;

$R_3$ is an ethyl group, a propyl group or an aralkyl group, of which an ethyl group, a propyl group, a benzyl group and a phenethyl group are preferred;

$V_1$, $V_2$, $V_3$, $V_4$, $V_5$, $V_6$ and $V_7$ are independently a hydrogen atom, a halogen atom, an aryl group, an alkyl group, a substituted alkyl group, an alkoxy group, an alkoxycarbonyl group, a carboxy group or a hydroxy group, and $V_1$ and $V_2$, $V_2$ and $V_3$, $V_3$ and $V_4$, $V_5$ and $V_6$, or $V_6$ and $V_7$ may combine together to form a benzene ring;

$X_1$ is an acid anion; and m is 1 or 2, and when the sensitizing dye forms an intramolecular salt, m is 1.

The number of carbon atoms of alkyl groups and alkyl residues is independently 1 to 4.

The substituent groups of sensitizing dyes represented by formulae (I) and (II) are explained below.

Preferred examples of substituted and unsubstituted alkyl groups represented by $R_1$ and $R_2$ include an alkyl group, e.g., a methyl group, an ethyl group, a propyl group, and a butyl group; a hydroxyalkyl group, e.g., a 2-hydroxyethyl group, a 3-hydroxypropyl group, and 4-hydroxybutyl group; a carboxyalkyl group, e.g., a carboxymethyl group, a 2-carboxyethyl group, a 3-carboxypropyl group, a 4-carboxybutyl group, and a 2-(2-carboxyethoxy)ethyl group; a sulfoalkyl group, e.g., a 2-sulfoethyl group, a 3-sulfopropyl group, a 3-sulfobutyl group, a 4-sulfobutyl group, a 2-(3-sulfopropoxy)ethyl group, a 2-hydroxy-3-sulfopropyl group, a 3-sulfopropoxyethoxyethyl group, a 2-acetoxy-3-sulfopropyl group, and a 3-methoxy-2-(3-sulfopropoxy)propyl group; a vinylmethyl group; an aralkyl group, e.g., a benzyl group, a phenethyl group, a phenylpropyl group, and a phenylbutyl group; and a substituted aralkyl group, e.g., a p-tolylpropyl group, a p-methoxyphenethyl group, a p-chlorophenethyl group, a p-sulfobenzyl group, a p-sulfophenethyl group, and a p-carboxybenzyl group.

Of these groups, particularly preferred examples are methyl, ethyl, propyl, butyl, 2-hydroxyethyl, 3-hydroxypropyl, carboxymethyl, 2-carboxymethyl, 3-carboxypropyl, 2-sulfoethyl, 3-sulfopropyl, 3-sulfobutyl, 4-sulfobutyl, vinylmethyl, phenethyl, phenylpropyl, phenylbutyl, p-sulfobenzyl, p-sulfophenethyl, p-carboxybenzyl, etc., groups.

Preferred examples of alkyl and aralkyl groups represented by R include an alkyl group, e.g., a methyl group, an ethyl group, a propyl group and a butyl group; and an aralkyl group, e.g., a benzyl group, a phenethyl group, a phenylpropyl group, and a phenylbutyl group. Of these groups, an ethyl group, a phenethyl group and a benzyl group are preferred.

For R, an ethyl group is particularly preferred.

$W_1$, $W_2$, $W_3$ and $W_4$ represent a hydrogen atom; a halogen atom, e.g., a fluorine atom, a chlorine atom, a bromine atom and an iodine atom; an aryl group, e.g., a phenyl group; an aralkyl group, e.g., a methyl group, an ethyl group, a propyl group, an isopropyl group, and a butyl group; a substituted alkyl group, e.g., a trifluoromethyl group; an alkoxy group, e.g., a methoxy group, an ethoxy group and a propoxy group; an alkoxycarbonyl group, e.g., a methoxycarbonyl group and an ethoxycarbonyl group; a carboxy group; and a hydroxy group.

$R_4$ and $R_5$ are the same as defined for $R_1$ and $R_2$.

$V_1$, $V_2$, $V_3$, $V_4$, $V_5$, $V_6$ and $V_7$ are the same as defined for $W_1$, $W_2$, $W_3$ and $W_4$. In $W_1$ to $W_4$, however, it is preferred that $W_1$ and $W_2$ are each a chlorine atom, a phenyl group, a methyl group, a methoxy group or a trifluoromethyl group, and $W_3$ and $W_4$ are each a hydrogen atom.

X and $X_1$ are each an acid anion which is used for the usual cyanine dye salt, for example, an iodide ion, a bromide ion, a chloride ion, a p-toluenesulfonic acid ion, a benzenesulfonic acid ion, a sulfuric acid ion, a perchlorate ion, and a rhodan ion.

Representative examples of sensitizing dyes for use in the invention are given below, although the invention is not limited thereto.

Sensitizing dyes represented by formula (I):

I-1

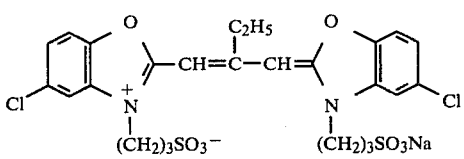

I-2

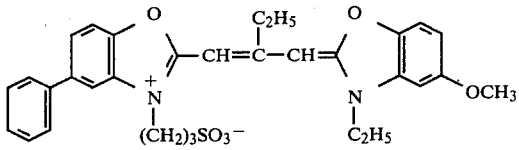

I-3

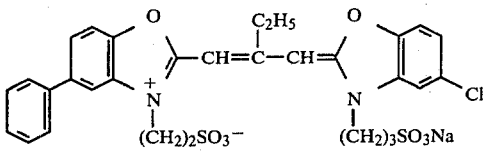

I-4

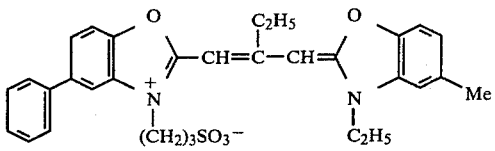

I-5

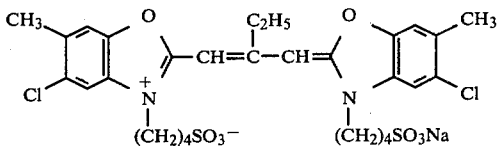

I-6

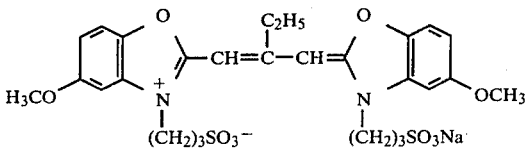

-continued
I-7
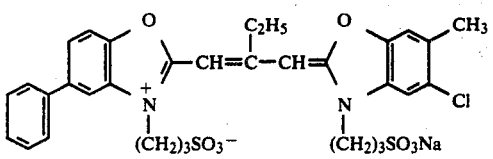
I-8
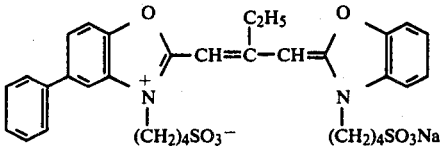
I-9
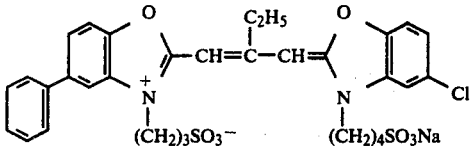
I-10
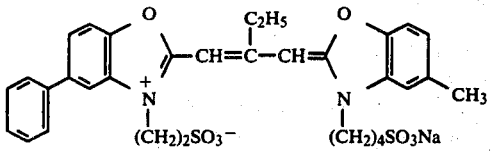
I-11
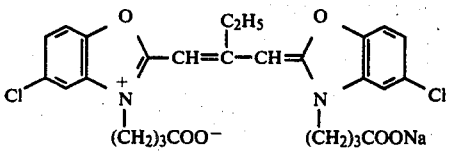
I-12
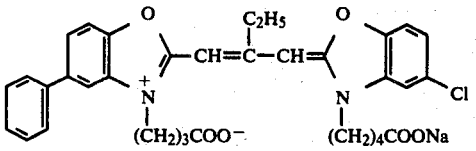
I-13
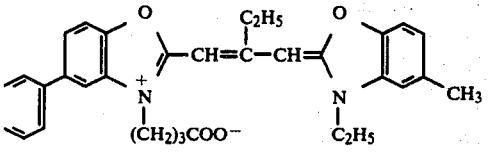
I-14
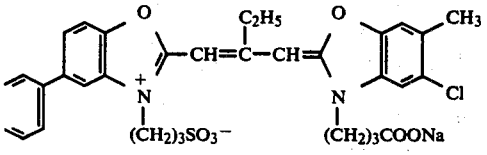
Sensitizing dyes represented by formula (II):
II-1
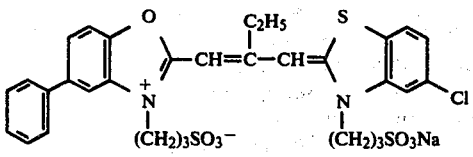
-continued
II-2
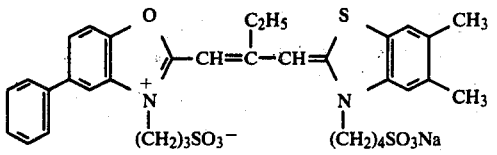
II-3
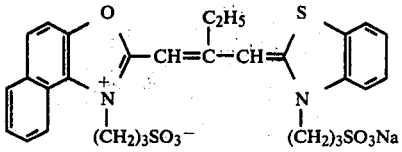
II-4
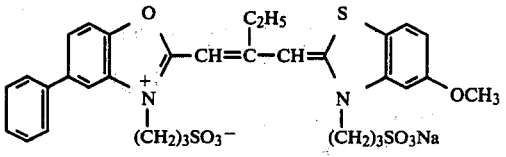
II-5
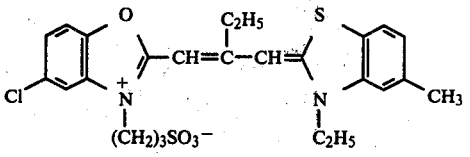
II-6
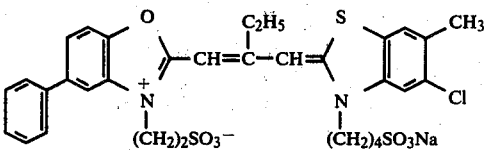
II-7
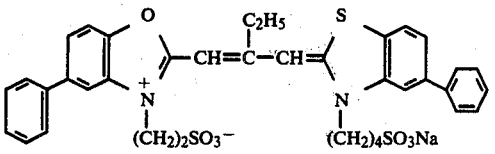
II-8
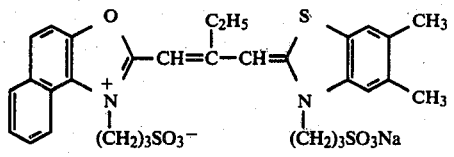
II-9
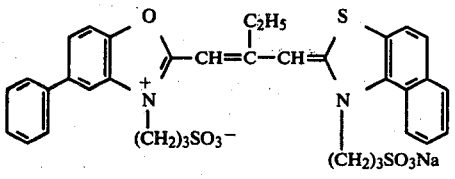
II-10
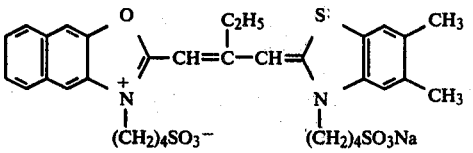
II-11
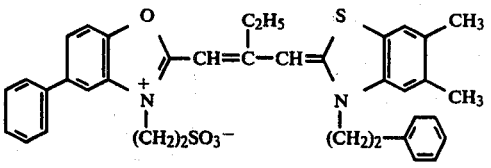

-continued

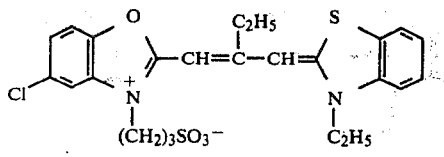

II-12

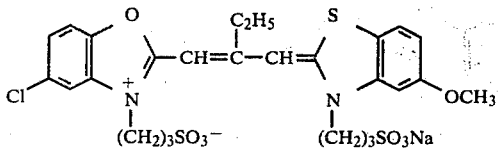

II-13

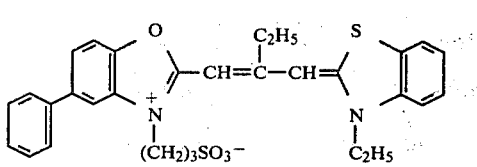

II-14

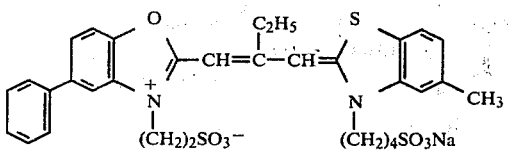

II-15

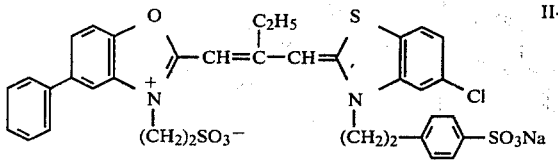

II-16

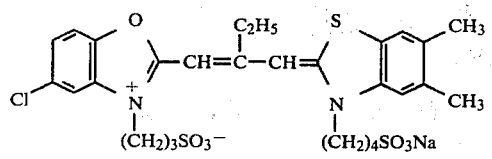

II-17

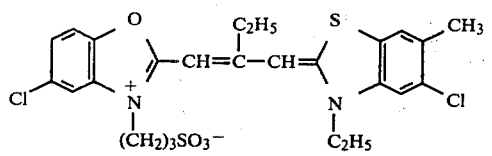

II-18

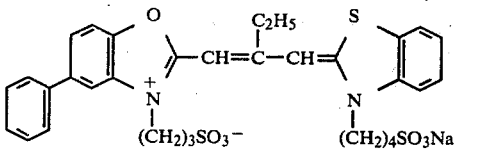

II-19

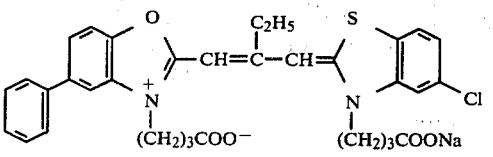

II-20

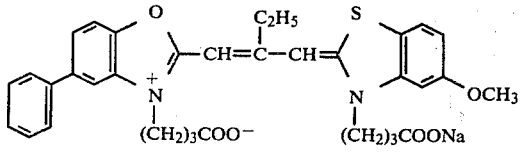

II-21

-continued

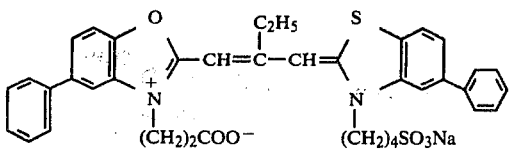

II-22

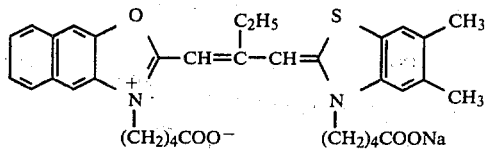

II-23

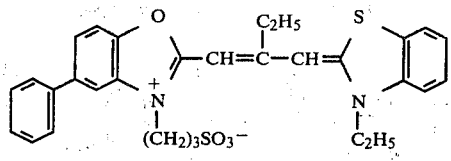

II-24

Particularly preferred examples of the sensitizing dyes represented by formula (I) include I-1, I-3, I-4, I-9 and I-10.

Also, particularly preferred examples of the sensitizing dyes represented by formula (II) include II-1, II-2, II-4, II-12, II-14, II-15, II-17 and II-18.

The amount of each of the sensitizing dyes represented by formulae (I) and (II) to be contained in the silver halide photographic emulsion is about $1\times10^{-6}$ to $5\times10^{-3}$ mol, preferably about $1\times10^{-5}$ to $2.5\times10^{-3}$ mol, and most preferably about $4\times10^{-5}$ to $1\times10^{-3}$ mol, per mol of silver halide.

The molar ratio of the dye represented by formula (II) to the dye represented by formula (I) is preferably about 1:10 to 20:1 and most preferably about 1:2 to 10:1.

Sensitizing dyes other than the compounds represented by formulae (I) and (II) may be added in combination therewith.

The silver halide photographic emulsion of the invention can be prepared by the usual procedure. For example, it can contain silver chloride, silver bromide, silver iodide or mixed silver halide particles which are precipitated and ripened by a single jet process, a double jet process or a composite process thereof. Preferred examples of such silver halides are silver iodobromide and silver chloroiodobromide. Either fine silver halide particles or coarse silver halide particles can be used. The average diameter of silver halide particles (measured by, for example, a projected area method; number average diameter) is preferably about 0.04 to 4 μm.

The silver halide photographic emulsion used in the invention may be subjected to a usual chemical sensitization method, such as gold sensitization (as described in U.S. Pat. Nos. 2,399,083, 2,540,085, 2,597,856, 2,597,915, etc.), sensitization with Group VII metal ions (as described in U.S. Pat. Nos. 2,448,060, 2,540,086, 2,566,245, 2,566,263, 2,598,079, etc.), sulfur sensitization (as described in U.S. Pat. Nos. 1,574,944, 2,278,947, 2,440,206, 2,410,689, 3,189,458, 3,415,649, etc.), reduction sensitization (as described in U.S. Pat. Nos. 2,518,698, 2,419,974, 2,983,610, etc.) and a composite sensitization method thereof.

Examples of chemical sensitizers which can be used include sulfur sensitizers, such as allylthiocarbamido, thiourea, sodium thiosulfate and cystine; noble metal sensitizers, such as potassium chloroaurate, aurous thiosulfate and potassium chloropalladate; and reduction sensitizers, such as tin chloride, phenylhydrazine and reductone. Furthermore, the silver halide photographic emulsion may contain sensitizers such as polyoxyethylene compounds, polyoxypropylene compounds and those compounds containing a quaternary ammonium group.

To the photographic emulsion of the invention can be added various compounds for the purpose of preventing reduction in sensitivity and the formation of fog during the course of production, storage or processing of light-sensitive elements. As such compounds, a great number of compounds, such as heterocyclic compounds, mercury-containing compounds, mercapto compounds, and metal salts, which are exemplified by nitrobenzimidazole, ammonium chloroplatinate, 4-hydroxy-6-methyl-1,3,3*a*,7-tetraazaindene, 3-methylbenzothiazole, and 1-phenyl-5-mercaptotetrazole, are known. Examples of such compounds which can be used for the foregoing purpose are described in K. Mees, *The Theory of the Photographic Process,* pages 344–349, 3rd. Ed. (1966) referring to the original papers, and in U.S. Pat. Nos. 1,758,576, 2,110,178, 2,131,038, 2,173,628, 2,697,040, 2,304,962, 2,324,123, 2,394,198, 2,444,605 to 2,444,608, 2,566,245, 2,694,716, 2,697,099, 2,708,162, 2,728,663 to 2,728,665, 2,476,536, 2,824,001, 2,843,491, 3,052,544, 3,137,577, 3,220,839, 3,226,231, 3,236,652, 3,251,691, 3,252,799, 3,287,135, 3,326,681, 3,420,668 and 3,622,339, British Pat. Nos. 893,428, 403,789, 1,173,609, and 1,200,188, etc.

The silver halide photographic emulsion of the invention can be hardened by the usual technique. Examples of hardeners which can be used include aldehyde compounds, such as formaldehyde and glutaraldehyde; ketone compounds, such as diacetyl and cyclopentanedione; reactive halogen-containing compounds, such as bis(2-chloroethylurea), 2-hydroxy-4,6-dichloro-1,3,5-triazine, and those as described in U.S. Pat. Nos. 3,288,775 and 2,732,303, British Pat. Nos. 974,723 and 1,167,207, etc.; reactive olefin-containing compounds, such as divinylsulfone, 5-acetyl-1,3-diacryloylhexahydro-1,3,5-triazine, and those as described in U.S. Pat. Nos. 3,635,718 and 3,232,763, British Pat. No. 994,869, etc.; N-methylolated compounds, such as N-hydroxymethylphthalimide and those as described in U.S. Pat. Nos. 2,732,316 and 2,586,168, etc.; isocyanates as described in U.S. Pat. No. 3,103,437, etc.; aziridine compounds as described in U.S. Pat. Nos. 3,017,280 and 2,983,611, etc.; acid derivatives as described in U.S. Pat. Nos. 2,725,294 and 2,725,295, etc.; carbodiimido-based compounds as described in U.S. Pat. No. 3,100,704, etc.; epoxy compounds as described in U.S. Pat. No. 3,091,537, etc.; isoxazoles as described in U.S. Pat. Nos. 3,321,313 and 3,543,292, etc.; halogenocarboxyaldehydes such as mucochloric acid; dioxane derivatives such as dihydroxydioxane and dichlorodioxane; and inorganic hardeners such as chromium alum and zirconium sulfate. In place of the foregoing compounds, precursors such as an alkali metal-bisulfite aldehyde adduct, a methylol derivative of hydantoin and primary aliphatic nitroalcohol may be used.

Surfactants may be added to the photographic emulsion of the invention, alone or in combination with each other. These surfactants are usually used as auxiliary coating agents. In some cases, they are used for other purposes, for example, emulsification and dispersion, improvements in sensitized photograhic characteristics, prevention of charging, and prevention of adhesion. Surfactants which can be used are classified into a natural surfactant, such as saponin; a nonionic surfactant, such as alkyleneoxide-, glycerol and glycidol-based surfactants; a cationic surfactant, such as higher alkylamines, quaternary ammonium salts, heterocyclic compounds, e.g., pyridine, phosphoniums and sulfoniums; an anionic surfactant containing an acid group, such as carboxylic acid, sulfonic acid, phosphoric acid, a sulfate group and a phosphate group; and an amphoteric surfactant, such as amino acid, aminosulfonic acids, and sulfuric acid or phosphoric acid esters of aminoalcohol.

Examples of such surfactants which can be used are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174 and 3,545,974, German Patent Application No. 1,942,665, British Pat. Nos. 1,077,317 and 1,198,450, and in Ryohei Oda, et al., *Synthesis and Application of Surfactants,* Maki Shoten, Japan (1964), A. W. Perry, *Surface Active Agents,* Interscience Publication Incorporated (1958), and J. P. Sisley, *Encyclopedia of Surface Active Agents,* Vol. 2, Chemical Publish Co. (1964).

To the silver halide photographic emulsion used in the invention, acylated gelatin such as phthalated gelatin and malonated gelatin in addition to gelatin; cellulose compounds, such as hydroxyethyl cellulose and carboxymethyl cellulose; soluble starch, such as dextrin; and hydrophilic polymers, such as polyvinyl alcohol, polyvinyl pyrrolidone, polyacrylamide and polystyrenesulfonic acid, can be added as protective colloids, and a plasticizer for the stabilization of dimensions, a latex polymer, and a matting agent can be added.

The thus-finished emulsion is coated on an appropriate support, such as a baryta paper, a resin-coated paper, a synthetic paper, a triacetate film, a polyethylene terephthalate film, other platic supports, or a glass plate.

The sensitizing dyes for use in the invention can be directly dispersed in the emulsion. Alternatively, they may be first dissolved in a suitable solvent, such as metyl alcohol, ethyl alcohol, methyl cellosolve, acetone, water, pyridine, and a mixture thereof, and then added to the emulsion in the form of a solution. In the latter case, the sensitizing dyes may be dissolved by the use of supersonic vibration as described in U.S. Pat. No. 3,485,634. Other methods which can be used to disperse the sensitizing dyes of the invention in the emulsion or to add thereto in the form of a solution are described in U.S. Pat. Nos. 3,482,981, 3,585,195, 3,469,987, 3,425,835 and 3,342,605, British Pat. Nos. 1,271,329, 1,038,029 and 1,121,174, Japanese Patent Publication No. 24185/71, U.S. Pat. Nos. 3,822,135, 3,660,101, 2,912,343, 2,996,287, 3,429,835 and 3,658,546. In addition, those methods as described in German Patent Application No. 2,104,283 and U.S. Pat. No. 3,649,286 can be used.

Although the sensitizing dyes of the invention are uniformly dispersed in the silver halide emulsion prior to the coating of the silver halide emulsion on a suitable support, they may be dispersed at any stage in the course of the preparation of the silver halide emulsion.

The silver halide photographic emulsion of the invention can contain color couplers, dsuch as a cyan coupler, a magenta coupler, and a yellow coupler, and compounds in which such couplers are to be dispersed. That is, it can contain compounds capable of forming color or undegoing the oxidation coupling with aromatic primary amine developing agents, such as phenylenediamine derivatives and aminophenol derivatives, at color development.

Examples of useful magenta couplers include a 5-pyrazolone coupler, a pyrazolobenzimidazole coupler, a cyanoacetylcumarone coupler, and an open-chain acylactonitrile coupler. Examples of yellow couplers which can be used include acylacetamide couplers (e.g., benzoylacetanilides and pivaloylacetanilides). Examples of cyan couplers which can be used include a naphthol coupler and a phenol coupler. It is preferred that these couplers contain a hydrophobic group called a ballast group in the molecule and thus are non-diffusing.

These couplers may be either 4-equivalent or 2-equivalent for a silver ion. They may be colored couplers having the color correction effect or couplers (so-called DIR couplers) releasing a development inhibitor as the development proceeds. Besides these DIR couplers, colorless DIR coupling compounds, the coupling reaction product of which is colorless and releases a development inhibitor, can be added. The color couplers may contain, in particular, a magenta coupler which may be either a 4-equivalent magenta coupler or a 2-equivalent magenta coupler, and preferably which is a 2-equivalent magenta coupler.

Examples of magenta couplers which can be used are described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, German Pat. No. 1,810,464 German Patent Application (OLS) Nos. 2,408,665, 2,417,945, 2,418,959 and 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76, 55122/78 (the term "OPI" as used herein refers to a "published unexamined Japanese patent application"), Japanese Patent Application Nos. 121689/79, 136497/79, 163167/79, 163168/79, 31320/79, etc.

Examples of yellow couplers which can be used are described in U.S. Pat. Nos. 2,875,057, 3,265,506, 3,408,194, 3,551,155, 3,582,322, 3,725,072, 3,891,445, German Pat. No. 1,547,868, German Patent Application (OLS) Nos. 2,219,917, 2,261,361, 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77, 115219/77, etc.

Examples of cyan couplers which can be used are described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 4,004,929, German Patent Application (OLS) Nos. 2,414,830, 2,454,329, Japanese Patent Application (OPI) Nos. 59838/73, 26034/76, 5055/73, 146828/76, 69624/77, and 90932/77.

Examples of colored couplers which can be used are described in U.S. Pat. Nos. 3,476,560, 2,521,908, 3,034,892, Japanese Patent Publication Nos. 2016/69, 22335/63, 11304/67, 32461/69, Japanese Patent Application (OPI) Nos. 26034/76, 42121/77, and German Patent Application (OLS) No. 2,418,959.

Examples of DIR couplers which can be used are described in U.S. Pat. Nos. 3,227,554, 3,617,291, 3,701,783, 3,790,384, 3,632,345, German Patent Application (OLS) Nos. 2,414,006, 2,454,301, 2,454,329, British Pat. No. 953,454, Japanese Patent Application (OPI) Nos. 69624/77, 122335/74, and Japanese Patent Publication No. 16141/76.

Besides these DIR couplers, the light-sensitive element may contain those compounds which release a development inhibitor as the development proceeds. Examples of such compounds which can be used are described in U.S. Pat. Nos. 3,297,445, 3,379,529, German Patent Application (OLS) No. 2,417,914, Japanese Patent Application (OPI) Nos. 15271/77 and 9116/78.

The combination of the sensitizing dyes in accordance with the invention can be used for the sensitization of various silver halide photographic emulsions for color and black-and-white light-sensitive elements. Examples of such emulsions to which the combinations of the invention can be applied include an emulsion for a color positive film, an emulsion for a color paper, an emulsion for a color negative film, an emulsion for color reversal film (which may contain a coupler or may not), an emulsion for a photographic light-sensitive elment which is to be used for the production of a printing plate (e.g., a lith film), an emulsion for use in a light-sensitive element which is to be used for cathode ray display, an emulsion for use in a light-sensitive element which is to be used for X-ray recording (particularly, an element for direct or indirect projection which is used in a screen), an emulsion for use in the colloid transfer process (as described in, for example, U.S. Pat. No. 2,716,059), an emulsion for use in the silver salt diffusion transfer process (as described in, for example, U.S. Pat. Nos. 2,352,014, 2,543,181, 3,020,155, and 2,861,885), an emulsion for use in the color diffusion transfer process (as described in, for example, U.S. Pat. Nos. 3,087,817, 3,185,567, 2,983,606, 3,253,915, 3,227,550, 3,227,551, 3,227,552, 3,415,644, 3,415,645 and 3,415,646), an emulsion for use in the imbibition transfer process (as described in, for example, U.S. Pat. No. 2,882,156), an emulsion for use in the silver dye bleach process (as described in, for example, Friedman, *History of Color Photography,* American Photographic Publishers Co. (1944), Chapter 24, and *British Journal of Photography,* Vol. 111, pages 308–309, Apr. 7, 1964), an emulsion for use in an element in which a print-out image is to be recorded (as described in, for example, U.S. Pat. No. 2,369,449 and Beligan Pat. No. 704,976), an emulsion for use in a direct print image type of light-sensitive element (as described in, for example, U.S. Pat. Nos. 3,033,682 and 3,287,137), an emulsion for use in a heat development type of light-sensitive element (as described in, for example, U.S. Pat. Nos. 3,152,904, 3,312,550 and 3,148,122, and British Pat. No. 1,110,046), and an emulsion for use in a physical development type of light-sensitive element (as described in, for example, British Pat. Nos. 920,277 and 1,131,238).

The silver halide photographic emulsion of the invention is particularly useful when used in color reversal films or color negative films.

To the silver halide photographic emulsion of the invention may be added a water-soluble dye as a filter dye for various purposes such as preventing irradiation. Examples of water-soluble dyes which can be used for such purposes include oxonol dye, hemioxonol dye, styryl dye, merocyanine dye, cyanine dye and azo dye. Of these dyes, oxonol dye, hemioxonol dye and merocyanine dye are useful. Examples of water-soluble dyes which can be used are described in British Pat. Nos. 546,708, 584,609, 1,265,842 and 1,410,488, and U.S. Pat. Nos. 2,274,782, 2,286,714, 2,526,632, 2,606,833, 2,956,879, 3,148,187, 3,247,127, 3,481,927, 3,575,704, 3,653,905 and 3,718,472.

Application of light-exposure to obtain a photographic image is carried out by conventional techniques. Any known light sources, such as natural light, a tungsten lamp, a fluorescent lamp, a mercury lamp, a xenon flash lamp and a cathode-ray flange spot, can be used. For the photographic emulsion of the invention, the application of light-exposure may be performed for about 1/1,000 second to 1 second, which time is used for the usual cameras. When a xenon lamp or cathode-ray tube is used, the photographic emulsion of the invention may be subjected to the light-exposure for about $1/10^4$ to $1/10^6$ second. Furthermore, the application of light-exposure for about 1 second or more may be performed.

If necessary, the spectral composition of light for use in light-exposure can be controlled by the use of a color filter. For the application of light-exposure, a laser light can be used. Furthermore, the light-exposure may be performed by the use of light emitted from a fluorescemt substance which is excited by electron rays, X-rays, $\gamma$-rays, $\alpha$-rays, etc.

Photographic processing of light-sensitive elements prepared using the photographic emulsion of the invention can be performed by known techniques. For example, known processing solutions can be used, and the processing temperature is usually about 18° to 50° C., but may be lower than about 18° C. or higher than about 50° C. According to the purpose for which the light-sensitive element is used, either black-and-white photographic processing for forming silver images or color photograph is processing for forming dye images can be used.

Developers for use in the black-and-white photographic processing can contain known developing agents. Examples of developing agents which can be used include dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, and heterocyclic compounds as described in U.S. Pat. No. 4,067,872, which are similar to the condensation product of a 1,2,3,4-tetrahydroquinoline ring and an indolene ring. These developing agents can be used alone or in combination with each other. The developer generally contains known photographic additives, such as a preservative, an alkali agent, a pH buffer and an antifoggant, and it may contain, if necessary, an auxiliary dissolving agent, a color controller, a development accelerator, a surfactant, a defoaming agent, a water softener, a hardener, a viscosity increasing agent and the like.

To the photographic emulsion of the invention, the so-called "lith type" development processing can be applied. In accordance with the lith type development processing, photographic reproduction of line images or photographic reproduction of half tone images in terms of dots is usually performed infectiously with dihydroxybenzenes as developing agents and at a low concentration of sulfite ions (the details are described in Mason, *Photographic Processing Chemistry,* pages 163–165 (1966).

Conventional fixer compositions can be used in the invention.

Examples of fixing agents which can be used include thiosulfuric acid salts and thiocyanic acid salt, and additionally organic sulfur compounds which are known to have the effect as a fixing agent. These fixers may contain water-soluble aluminum salts as hardeners.

Dye images can be formed by the usual techniques. Such techniques include a negative-positive process (as described in *Journal of the Society of Motion Picture and Television Engineers,* Vol. 61, pages 667–701 (1953), a color reversion process in which a negative silver image is formed by developing with a developer containing a black-and-white developing agent, is subjected to at least one uniform exposure or suitable fog processing, and then is subjected to color development to provide a dye positive image, and a silver dye bleach process in which a photographic emulsion layer containing a dyestuff is exposed and then developed to provide a silver image, and with the thus-formed silver image as a bleach catalyst, the dyestuff is bleached.

A color developer generally comprises an alkaline solution containing therein a color developing agent. Examples of color developing agents which can be used include phenylenediamines, such as 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfoaminoethylaniline, and 4-amino-3-methyl-N-ethyl-N-$\beta$-methoxyethylaniline. In addition, those as described in F. A. Mason, *Photographic Processing Chemistry,* pages 226–229, Focal Press (1966), and U.S. Pat. Nos. 2,193,015 and 2,592,364, Japanese Patent Application (OPI) No. 64933/73, etc., may be used.

The color developer can also contain pH buffers, such as sulfurous acid salts, carbonic acid salts, phosphoric acid salts and boric acid salts of alkali metals; development inhibitors or antifoggants, such as bromides, iodides and organic antifoggants; and the like. Furthermore, if necessary, it may contain a water softener; a preservative, such as hydroxylamine; an organic solvent, such as benzyl alcohol and diethylene glycol; a development accelerator, such as polyethylene glycol, quanternary ammonium salts and amines; a dye-forming coupler; a competing coupler; a fogging agent, such as sodium borohydride; an auxiliary developing agent, such as 1-phenyl-3-pyrazolidone; a viscosity increasing agent; a chelating agent derived from polycarboxylic acid as described in U.S. Pat. No. 4,083,723; an antioxidant as described in German Patent Application (OLS) No. 2,622,950; and the like.

After the color development processing, the photographic emulsion layer is usually subjected to bleach processing. The bleach processing and fixation processing may be performed either at the same time or individually. Examples of bleaching agents which can be used include multivalent metal (e.g., iron (III), cobalt (IV), chromium (VI) and copper (II)) compounds, peracids, quinones and nitroso compounds. In more detail, ferricyan compounds; perchromic acid salts; organic complex salts of iron (III) and (IV), e.g., complex salts of aminopolycarboxylic acids, such as ethylenediaminetetraacetic acid, nitrilotriacetic acid, and 1,3-diamino-2-propanoltetraacetic acid, and organic acids, such as citric acid, tartaric acid and malic acid; persulfuric acid salts and permanganic acid salts; nitrosophenol; and the like can be used. Of these compounds, potassium ferricyanide, an ethylenediaminetetraacetic acid iron (III) sodium complex salt, and an ethylenediaminetetraacetic acid iron (III) ammonium complex salt are particularly useful. The ethylenediaminetetraacetic acid iron (III) complex salt is useful in any of the independent bleaching solution, the monobath bleaching solution, and the monobath bleach-fixing solution.

To the bleaching solution or bleach-fixing solution can be added various additives in addition to bleach accelerators as described in U.S. Pat. Nos. 3,042,520, 3,241,966, Japanese Patent Publication Nos. 8506/70, 8836/70, etc., and thiol compounds as described in Japanese Patent Application (OPI) No. 65732/78.

Light-sensitive elements prepared using the photographic emulsions of the invention may be processed with developers which are replenished or maintained by the methods described in Japanese Patent Application (OPI) Nos. 84636/76, 119934/77, 46732/78, 9626/79, 19741/79 and 37731/79, and Japanese Patent Application Nos. 76158/79, 76159/79 and 102962/79.

Bleach-fixing solutions which are subjected to reproduction processing by the methods described in Japanese Patent Application (OPI) Nos. 781/71, 49437/73, 18191/73, 145231/75, 18541/76, 196535/76 and 144620/76, and Japanese Patent Publication No. 23178/76 may be used in the processing of the light-sensitive elements prepared using the photographic emulsions of the invention.

For the purposes of increasing sensitivity and contrast, and of accelerating development, polyalkylene oxide or its ether, ester, amine or like derivatives, thioether compounds, thiomorpholines, quaternary ammonium chloride compounds, urea derivatives, imidazole derivatives, 3-pyrazolidones, etc., may be incorporated into the photographic emulsion of the invention. For example, those as described in U.S. Pat. Nos. 2,400,532, 2,423,549, 2,716,062, 3,617,280, 3,772,021 and 3,808,003, and British Patent 1,488,991, etc., can be used.

Some of the major features of the invention are given below:

(1) The silver halide photographic emulsion obtained using a combination of sensitizing dyes represented by formulae (I) and (II) has high sensitivity;

(2) The silver halide photographic emulsion obtained is reduced in the level of residual color and in the formation of fog; and (3) The silver halide photographic emulsion obtained is less changed in photographic characteristics, such as sensitivity and fog, during the storage thereof.

The following examples are given to illustrate the invention in greater detail although the invention is not limited thereto.

EXAMPLE 1

Silver halide particles were precipitated by the double jet process, and they were subjected to physical ripening and after desalting processing, to chemical ripening to obtain a silver iodobromide emulsion (iodo content: 7 mol%). The average diameter of the silver halide particles contained in the emulsion thus-obtained was 0.8 μm. The amount of silver halide contained in the emulsion was 0.52 mol per kg of the emulsion.

1 kg of the emulsion was weighed, placed in a pot, and melted by heating at 40° C. Predetermined amounts of methanol solutions of sensitizing dyes were added to the thus-melted emulsion, and the resulting mixture was stirred. Furthermore, 10 ml of a 1.0% aqueous solution of 4-hydroxy-6-methyl-1,3,3a,7-tetrazaindene, 10 ml of a 1.0% by weight aqueous solution of a 1-hydroxy-3,5-dichlorotriazine sodium salt, and 10 ml of a 1.0% by weight aqueous solution of sodium dodecylbenzenesulfonate were added thereto, and the mixture thus-obtained was then stirred to provide an emulsion.

The thus-obtained emulsion was coated on a cellulose triacetate film base in a dry thickness of 5 μm and dried to provide a light-sensitive element sample. This film sample was wedgewise exposed by the use of a sensitometer provided with a light source of a color temperature of 5,400° K., said light source being covered with a yellow filter (SC-50, produced by Fuji Photo Film Co., Ltd.). After the exposure, the film sample was developed at 20° C. for 3 minutes with a developer having the formulation shown below, stopped, fixed and further washed with water to obtain a strip having a predetermined black-and-white image.

For the thus-processed film, the sensitivity and fog were measured using a P-type densitometer (produced by Fuji Photo Film Co., Ltd.). The sensitivity was determined at the optical density of fog = +0.20.

| Composition of Developer | |
|---|---|
| Water | 500 ml |
| N—Methyl-p-aminophenol | 2.2 g |
| Anhydrous sodium sulfite | 96.0 g |
| Hydroquinone | 8.8 g |
| Sodium carbonate monohydrate | 56.0 g |
| Potassium bromide | 5.0 g |
| Water to make | 1 l |

The results are given in Tables 1 and 2 as relative values. From these results, it can be seen that the combination of the invention provides excellent light-sensitive elements having high sensitivity, reduced in fog density.

TABLE 1

| Test No. | Type and Amount of Sensitizing Dye ($\times 10^{-5}$ mol/kg emulsion) | | | | Sensitivity | Fog |
|---|---|---|---|---|---|---|
| 1 | I-1 | 10 | — | | 100 | 0.03 |
| 2 | I-1 | 20 | — | | 151 | 0.03 |
| 3 | I-1 | 40 | — | | 151 | 0.03 |
| 4 | | — | II-1 | 10 | 166 | 0.03 |
| 5 | | — | II-1 | 20 | 234 | 0.03 |
| 6 | | — | II-1 | 40 | 234 | 0.03 |
| 7 | I-1 | 20 | II-1 | 10 | 288 | 0.03 |
| 8 | I-1 | 20 | II-1 | 20 | 331 | 0.03 |
| 9 | | — | II-4 | 10 | 191 | 0.03 |
| 10 | | — | II-4 | 20 | 245 | 0.03 |
| 11 | I-1 | 20 | II-4 | 10 | 316 | 0.03 |
| 12 | I-1 | 20 | II-4 | 20 | 347 | 0.03 |
| 13 | | — | II-12 | 10 | 131 | 0.03 |
| 14 | | — | II-12 | 20 | 182 | 0.03 |
| 15 | I-1 | 20 | II-12 | 10 | 251 | 0.03 |
| 16 | I-1 | 20 | II-12 | 20 | 275 | 0.03 |
| 17 (comparison) | | — | A | 10 | 131 | 0.05 |
| 18 (comparison) | | — | A | 20 | 186 | 0.06 |
| 19 (comparison) | I-1 | 20 | A | 10 | 200 | 0.06 |
| 20 (comparison) | I-1 | 20 | A | 20 | 224 | 0.06 |

TABLE 2

| Test No. | Type and Amount of Sensitizing Dye ($\times 10^{-5}$ mol/kg emulsion) | | | | Sensitivity | Fog |
|---|---|---|---|---|---|---|
| 21 | I-2 | 10 | — | | 100 | 0.03 |
| 22 | I-2 | 20 | — | | 141 | 0.03 |
| 23 | I-2 | 40 | — | | 144 | 0.03 |
| 24 | | — | II-2 | 10 | 182 | 0.03 |
| 25 | | — | II-2 | 20 | 209 | 0.03 |
| 26 | | — | II-2 | 40 | 214 | 0.03 |
| 27 | I-2 | 10 | II-2 | 20 | 331 | 0.03 |
| 28 | I-2 | 20 | II-2 | 20 | 355 | 0.03 |
| 29 | I-3 | 10 | | — | 112 | 0.03 |
| 30 | I-3 | 20 | | — | 166 | 0.03 |
| 31 | I-3 | 10 | II-2 | 20 | 339 | 0.03 |
| 32 | I-3 | 20 | II-2 | 20 | 363 | 0.03 |
| 33 | I-7 | 10 | | — | 95 | 0.03 |

TABLE 2-continued

| Test No. | Type and Amount of Sensitizing Dye ($\times 10^{-5}$ mol/kg emulsion) | | | | Sensitivity | Fog |
|---|---|---|---|---|---|---|
| 34 | I-7 | 20 | | — | 133 | 0.03 |
| 35 | I-7 | 10 | II-2 | 20 | 266 | 0.03 |
| 36 | I-7 | 20 | II-2 | 20 | 280 | 0.03 |
| 37 (comparison) | B | 10 | | — | 110 | 0.06 |
| 38 (comparison) | B | 20 | | — | 151 | 0.07 |
| 39 (comparison) | B | 10 | II-2 | 20 | 224 | 0.06 |
| 40 (comparison) | B | 20 | II-2 | 20 | 248 | 0.07 |
| 41 (comparison) | B | 10 | C | 20 | 131 | 0.07 |
| 42 (comparison) | B | 20 | C | 20 | 182 | 0.07 |

A: Same dye as described in U.S. Pat. No. 3,397,060 (Dye A)

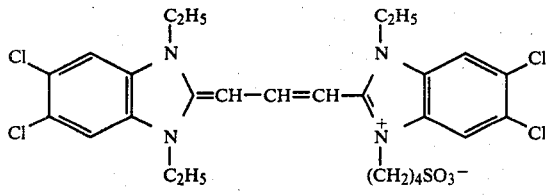

B: Same dye as described in Japanese Patent Publication No. 11627/71 (corresponding to U.S. Pat. No. 3,580,724) (Example 1)

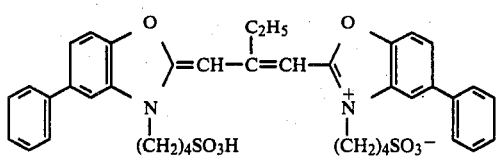

C: Same dye as described in Japanese Patent Publication No. 11627/71 (corresponding to U.S. Pat. No. 3,580,724) (Example 5)

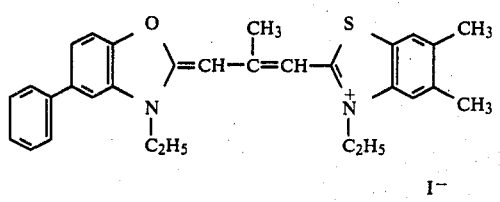

From the results shown in Table 1 above, it can be seen that the combinations of the invention, i.e., those of I-1 and II-1, of I-1 and II-4, and of I-1 and II-12 provide much improved sensitivity without increasing fog density as compared with the combination of I-1 and A.

Also, it can be evident from the results shown in Table 2 above that the combinations of the invention, i.e., those of I-2 and II-2, of I-3 and II-2 and of I-7 and II-2 provide much improved sensitivity without increasing fog density as compared with the combination of B and II-2 or that of B and C.

EXAMPLE 2

A silver iodobromide emulsion subjected to chemical sensitization and containing 8 mol% of silver iodide (average particle size: 1.1 μm; gelatin: 70 g/kg emulsion; amount of silver: 0.7 mol/kg emulsion) was obtained. 1 kg of the emulsion was heated to 40° C. to provide 500 g of an emulsion of Color Coupler D shown below. Then, 100 g of the emulsion of Color Coupler D was dissolved in 200 ml of ethyl acetate by the addition of tricresyl phosphate. Furthermore, sodium dodecylbenzenesulfonate was added as an auxiliary emulsification and dispersion agent. The thus-obtained mixture was emulsified and dispersed in 1,000 g of a 10% aqueous solution of gelatin by the use of a homoblender to provide an emulsion. To the thus-obtained emulsion was added predetermined amounts of methanol solutions of sensitizing dyes, and the resulting mixture was stirred. Furthermore, 20 ml of a 1.0% by weight aqueous solution of 4-hydroxy-6-methyl-1,3,3a,7-tetraazaindene, 50 ml of a 2.0% by weight aqueous solution of a 1-hydroxy-3,5-dichlorotriazine sodium salt, and 10 ml of a 2.0% by weight aqueous solution of sodium dodecylbenzenesulfonate were added thereto, and the resulting mixture was stirred.

The thus-prepared emulsion was coated on a cellulose triacetate film base so that the amount of silver coated was 5 g/m$^2$ and then dried to obtain a sample. This film sample was wedgewise exposed by the use of a sensitometer provided with a light source having a color temperature of 5,400° K., said light source being covered with a green filter (BPB-53, produced by Fuji Photo Film Co., Ltd.). After the exposure, it was developed with a developer having the formulation shown below, bleached, fixed and dried to form a magenta color image. The density of the thus-obtained color image was measured. The sensitivity was determined at the optical density of fog = +0.20. The results are shown in Table 3.

| | Temperature (°C.) | Time (minutes) |
|---|---|---|
| Development Processing | | |
| 1. Color development | 38 | 3.25 |
| 2. Bleaching | " | 6.5 |
| 2. Water-washing | " | 3.25 |
| 4. Fixing | " | 6.5 |
| 5. Water-washing | " | 3.25 |
| 6. Stabilization | " | 3.25 |
| Composition of Color Developer | | |
| Sodium nitrilotriacetate | | 1.0 g |
| Sodium sulfite | | 4.0 g |
| Sodium carbonate | | 30.0 g |
| Potassium bromide | | 1.4 g |
| Hydroxylamine sulfuric acid salt | | 2.4 g |
| 4-(N—Ethyl-N—β-hydroxyethylamino)-2-methylaniline sulfuric acid salt | | 4.5 g |
| Water to make | | 1 l |
| Composition of Bleaching Solution | | |
| Ammonium bromide | | 160.0 g |
| Ammonia water (28%) | | 25.0 ml |
| Ethylenediaminetetraacetic acid sodium iron salt | | 130.0 g |
| Glacial acetic acid | | 14.0 ml |
| Water to make | | 1 l |
| Composition of Fixing Solution | | |
| Sodium tetrapolyphosphate | | 2.0 g |
| Sodium sulfite | | 4.0 g |
| Ammonium thiosulfate (70%) | | 175.0 ml |
| Sodium hydrogensulfite | | 4.6 g |
| Water to make | | 1 l |
| Composition of Stabilizing Solution | | |
| Formalin | | 8 ml |
| Water to make | | 1 l |
| Coupler D: | | |

-continued

| | Temperature (°C.) | Time (minutes) |
|---|---|---|

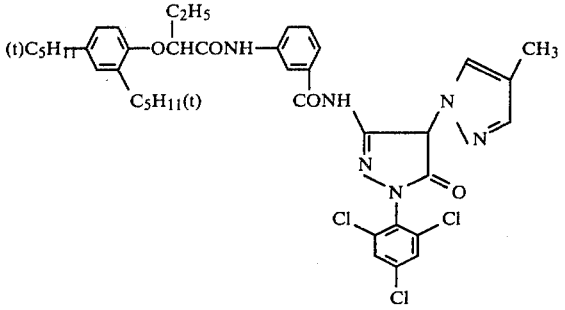

TABLE 3

| Test No. | Type and Amount of Sensitizing Dye (× $10^{-5}$ mol/kg emulsion) | | Just After Coating Sensitivity | Just After Coating Fog | After Storing (35° C., 65% RH, 2 weeks) Sensitivity | After Storing (35° C., 65% RH, 2 weeks) Fog |
|---|---|---|---|---|---|---|
| 43 | I-3 10 | — | 100 | 0.05 | 75 | 0.06 |
| 44 | " 20 | — | 144 | 0.05 | 121 | 0.06 |
| 45 | " 40 | — | 151 | 0.05 | 131 | 0.07 |
| 46 | — | II-1 10 | 177 | 0.05 | 151 | 0.06 |
| 47 | — | " 20 | 200 | 0.05 | 173 | 0.06 |
| 48 | — | " 40 | 209 | 0.05 | 173 | 0.07 |
| 49 | I-3 20 | II-1 10 | 309 | 0.05 | 302 | 0.06 |
| 50 | " 20 | " 20 | 347 | 0.05 | 338 | 0.06 |
| 51 | I-3 20 | II-11 10 | 316 | 0.05 | 309 | 0.06 |
| 52 | " 20 | " 20 | 339 | 0.05 | 331 | 0.06 |
| 53 (comparison) | I-3 20 | A 10 | 209 | 0.08 | 178 | 0.10 |
| 54 (comparison) | " 20 | " 20 | 224 | 0.09 | 195 | 0.12 |

From the results shown in Table 3 above, it can be seen that the combinations of the invention, i.e., those of I-3 and II-1 and of I-3 and II-11 provide much improved sensitivity without increasing fog density as compared with the combination of I-3 and A.

While the invention has been described in detail and with reference to specific embodiments thereof, it will be apparent to one skilled in the art that various changes and modifications can be made therein without departing from the spirit and scope thereof.

What is claimed is:

1. A light-sensitive silver halide photographic emulsion comprising a sensitizing dye represented by formula (I) and a sensitizing dye represented by formula (II):

(I)

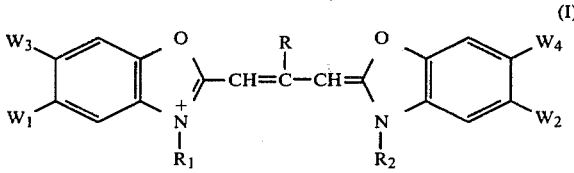

$(X)_{n-1}$

-continued (II)

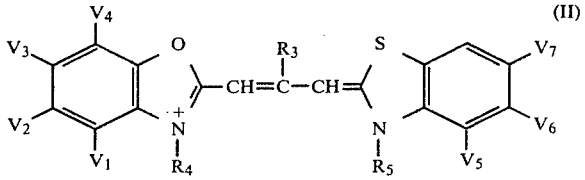

$(X_1)_{m-1}$ wherein $R_1$ and $R_2$ are each a substituted or unsubstituted alkyl group, and at least one of $R_1$ and $R_2$ is a sulfoalkyl group or a carboxyalkyl group;

R is an alkyl group or an aralkyl group;

$W_1$, $W_2$, $W_3$ and $W_4$ are each a hydrogen atom, a halogen atom, an aryl group, an alkyl group, a substituted alkyl group, an alkoxy group, an alkoxycarbonyl group, a carboxy group or a hydroxy group, and $W_1$ and $W_2$ are not phenyl groups at the same time;

X is an acid anion;

n is 1 or 2, and when the sensitizing dye forms an intramolecular salt, n is 1;

$R_4$ and $R_5$ are each a substituted or unsubstituted alkyl group, and at least one of $R_4$ and $R_5$ is a sulfoalkyl group or a carboxyalkyl group;

$R_3$ is an ethyl group, a propyl group or an aralkyl group;

$V_1$, $V_2$, $V_3$, $V_4$, $V_5$, $V_6$ and $V_7$ are each a hydrogen atom, a halogen atom, an aryl group, an alkyl group, a substituted alkyl group, an alkoxy group, an alkoxycarbonyl group, a carboxy group or a hydroxy group, and $V_1$ and $V_2$, $V_2$ and $V_3$, $V_3$ and $V_4$, $V_5$ and $V_6$ or $V_6$ and $V_7$ may combine together to form a benzene ring;

$X_1$ is an acid anion;

m is 1 or 2, and when the sensitizing dye forms an intramolecular salt, m is 1; and the number of carbon atoms contained in the alkyl group or alkyl radical is 1 to 4 wherein the sensitizing dyes of formula (II) and formula (I) are present in a molar ratio of 1:2 to 10:1.

2. The light-sensitive silver halide photographic emulsion as claimed in claim 1, wherein $R_1$ and $R_2$ are independently an alkyl group, a hydroxyalkyl group, a carboxyalkyl group, a sulfoalkyl group, a vinylmethyl group, an aralkyl group, or a substituted aralkyl group.

3. The light-sensitive silver halide photographic emulsion as claimed in claim 1, wherein $R_1$ and $R_2$ are independently a methyl group, an ethyl group, a propyl group, a butyl group, a 2-hydroxyethyl group, a 3-hydroxypropyl group, a carboxymethyl group, a 2-carboxyethyl group, a 3-carboxypropyl group, a 2-sulfoethyl group, a 3-sulfopropyl group, a 3-sulfobutyl group, a 4-sulfobutyl group, a vinylmethyl group, a phenethyl group, a phenylpropyl group, a phenylbutyl group, a p-sulfobenzyl group, a p-sulfophenethyl group or a p-carboxybenzyl group.

4. The light-sensitive silver halide photographic emulsion as claimed in claim 1, wherein R is an ethyl group, a phenethyl group or a benzyl group.

5. The light-sensitive silver halide photographic emulsion as claimed in claim 1, wherein R is an ethyl group.

6. The light-sensitive silver halide photographic emulsion as claimed in claim 1, wherein $R_4$ and $R_5$ are independently an alkyl group, a hydroxyalkyl group, a carboxyalkyl group, a sulfoalkyl group, a vinylmethyl group, an aralkyl group, or a substituted aralkyl group.

7. The light-sensitive silver halide photographic emulsion as claimed in claim 1, wherein $R_4$ and $R_5$ are independently a methyl group, an ethyl group, a propyl group, a butyl group, a 2-hydroxyethyl group, a 3-hydroxypropyl group, a carboxymethyl group, a 2-carboxyethyl group, a 3-carboxypropyl group, a 2-sulfoethyl group, a 3-sulfopropyl group, a 3-sulfobutyl group, a 4-sulfobutyl group, a vinylmethyl group, a phenethyl group, a phenylpropyl group, a phenylbutyl group, a p-sulfobenzyl group, a p-sulfophenethyl group or a p-carboxybenzyl group.

8. The light-sensitive silver halide photographic emulsion as claimed in claim 1, wherein $W_1$ and $W_2$ are independently a chlorine atom, a phenyl group, a methyl group, a methoxy group or a trifluoromethyl group.

9. The light-sensitive silver halide photographic emulsion as claimed in claim 1, wherein $W_3$ and $W_4$ are independently a hydrogen atom.

10. The light-sensitive silver halide photographic emulsion as claimed in claim 1, wherein said sensitizing dye represented by formula (I) is [I-1, I-3, I-4, I-9 or I-10]

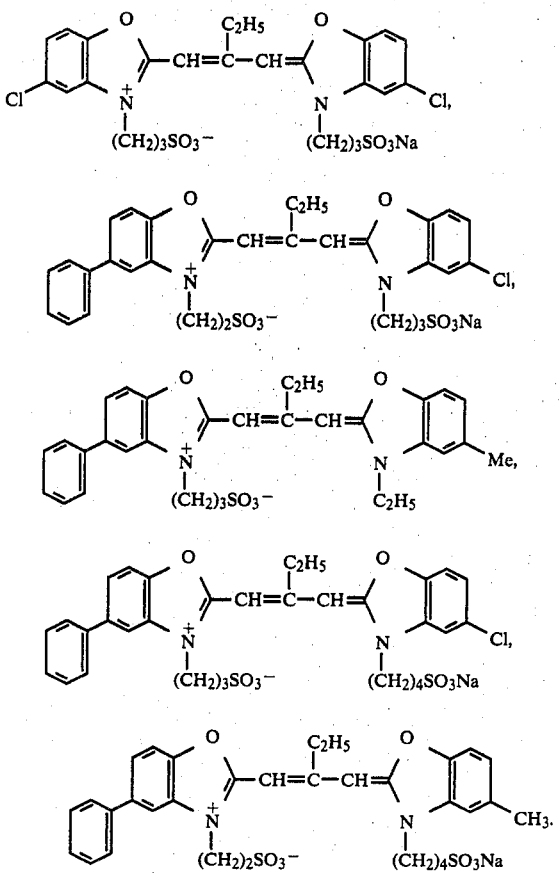

11. The light-sensitive silver halide photographic emulsion as claimed in claim 1, wherein said sensitizing dye represented by formula (II) is

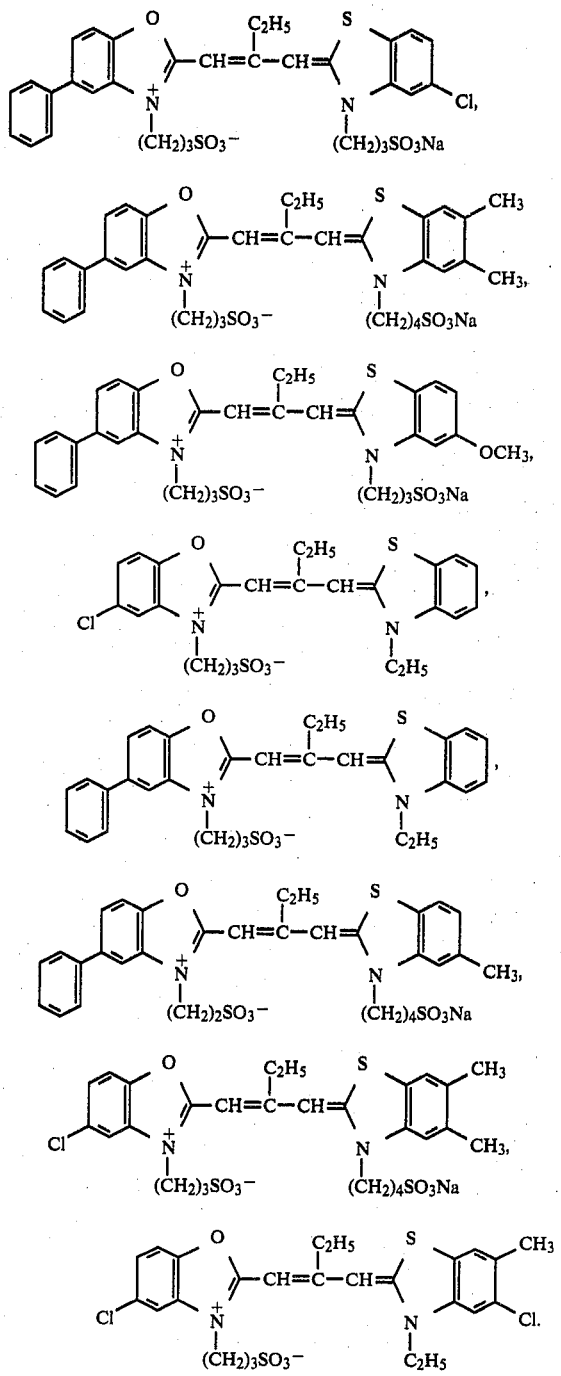

12. The light-sensitive silver halide photographic emulsion as claimed in claim 1 further comprising a color coupler.

13. The light-sensitive silver halide photographic emulsion as claimed in claim 12, wherein the color coupler is a magenta coupler.

14. The light-sensitive silver halide photographic emulsion as claimed in claim 13, wherein the magenta coupler is a 2-equivalent coupler.

15. A silver halide color photographic light-sensitive element comprising a support having thereon at least one lightsensitive emulsion layer comprising a sensitizing dye represented by formula (I) and a sensitizing dye represented by formula (II):

(I)

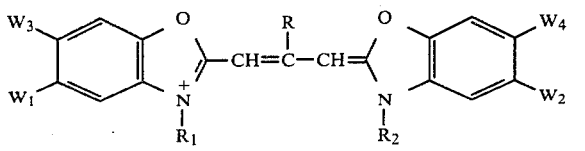

$(X)_{n-1}$ (II)

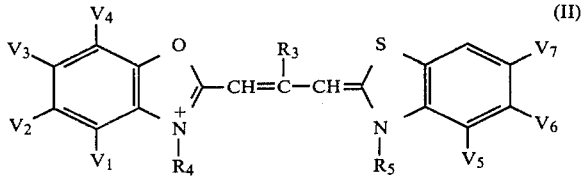

$(X_1)_{m-1}$ wherein $R_1$ and $R_2$ are each a substituted or unsubstituted alkyl group, and at least one of $R_1$ and $R_2$ is a sulfoalkyl group or a carboxyalkyl group;

R is an alkyl group or an aralkyl group;

$W_1$, $W_2$, $W_3$ and $W_4$ are each a hydrogen atom, a halogen atom, an aryl group, an alkyl group, a substituted alkyl group, an alkoxy group, an alkoxycarbonyl group, a carboxy group or an hydroxy group, and $W_1$ and $W_2$ are not phenyl groups at the same time;

X is an acid anion;

n is 1 or 2, and when the sensitizing dye forms an intramolecular salt, n is 1;

$R_4$ and $R_5$ are each a substituted or unsubstituted alkyl group, and at least one of $R_4$ and $R_5$ is a sulfoalkyl group or a carboxyalkyl group;

$R_3$ is an ethyl group, a propyl group or an aralkyl group;

$V_1$, $V_2$, $V_3$, $V_4$, $V_5$, $V_6$ and $V_7$ are each a hydrogen atom, a halogen atom, an aryl group, an alkyl group, a substituted alkyl group, an alkoxy group, an alkoxycarbonyl group, a carboxy group or a hydroxy group;

$X_1$ is an acid anion;

m is 1 or 2, and when the sensitizing dye forms an intramolecular salt, m is 1; and the number of carbon atoms contained in the alkyl group or alkyl radical is 1 to 4 wherein the sensitizing dyes represented by formula (II) and formula (I) are present in a molar ratio of 1:2 to 10:1.

16. The silver halide photographic light-sensitive element as claimed in claim 15, wherein $R_1$ and $R_2$ are independently an alkyl group, a hydroxyalkyl group, a carboxyalkyl group, a sulfoalkyl group, a vinylmethyl group, an aralkyl group, or a substituted aralkyl group.

17. The silver halide photographic light-sensitive element as claimed in claim 15, wherein $R_1$ and $R_2$ are independently a methyl group, an ethyl group, a propyl group, a butyl group, a 2-hydroxyethyl group, a 3-hydroxypropyl group, a carboxymethyl group, a 2-carboxyethyl group, a 3-carboxypropyl group, a 2-sulfoethyl group, a 3-sulfopropyl group, a 3-sulfobutyl group, a 4-sulfobutyl group, a vinylmethyl group, a phenethyl group, a phenylpropyl group, a phenylbutyl group, a p-sulfobenzyl group, a p-sulfophenethyl group or a p-carboxybenzyl group.

18. The silver halide photographic light-sensitive element as claimed in claim 15, wherein R is an ethyl group, a phenethyl group or a benzyl group.

19. The silver halide photographic light-sensitive element as claimed in claim 15, wherein R is an ethyl group.

20. The silver halide photographic light-sensitive element as claimed in claim 15, wherein $R_4$ and $R_5$ are independently an alkyl group, a hydroxyalkyl group, a carboxyalkyl group, a sulfoalkyl group, a vinylmethyl group, an aralkyl group, or a substituted aralkyl group.

21. The silver halide photographic light-sensitive element as claimed in claim 15, wherein $R_4$ and $R_5$ are independently a methyl group, an ethyl group, a propyl group, a butyl group, a 2-hydroxyethyl group, a 3-hydroxypropyl group, a carboxymethyl group, a 2-carboxyethyl group, a 3-carboxypropyl group, a 2-sulfoethyl group, a 3-sulfopropyl group, a 3-sulfobutyl group, a 4-sulfobutyl group, a vinylmethyl group, a phenethyl group, a phenylpropyl group, a phenylbutyl group, a p-sulfobenzyl group, a p-sulfophenethyl group or a p-carboxybenzyl group.

22. The silver halide photographic light-sensitive element as claimed in claim 15, wherein $W_1$ and $W_2$ are independently a chlorine atom, a phenyl group, a methyl group, a methoxy group or a trifluoromethyl group.

23. The silver halide photographic light-sensitive element as claimed in claim 15, wherein $W_3$ and $W_4$ are independently a hydrogen atom.

24. The silver halide photographic light-sensitive element as claimed in claim 15, wherein said sensitizing dye represented by formula (I) is

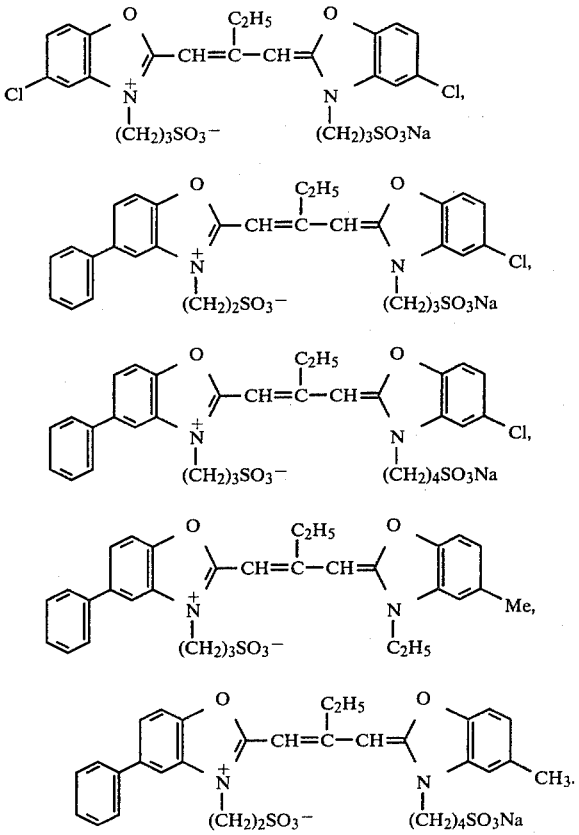

25. The silver halide photographic light-sensitive element as claimed in claim 15, wherein said sensitizing dye represented by formula (II) is

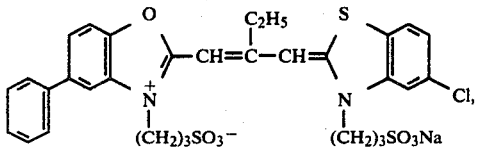

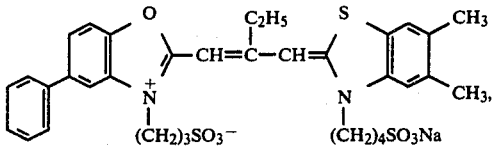

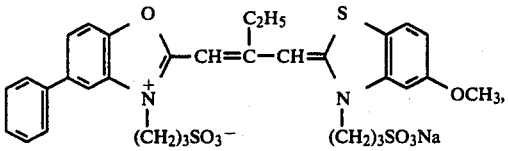

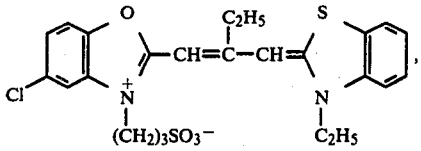

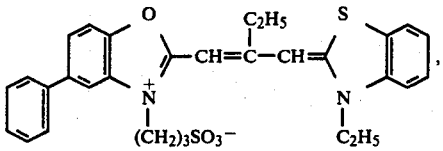

-continued

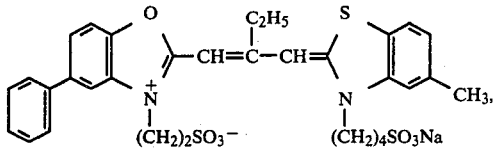

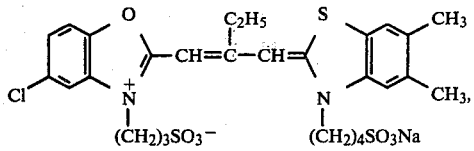

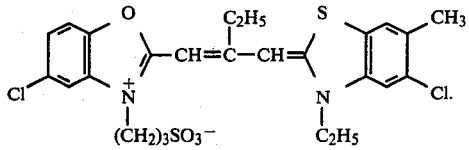

26. The silver halide photographic light-sensitive element as claimed in claim 15, further comprising a color coupler.

27. The silver halide photographic light-sensitive element as claimed in claim 15, wherein the color coupler is a magenta coupler.

28. The silver halide photographic light-sensitive element as claimed in claim 15, wherein the magenta coupler is a 2-equivalent coupler.

29. The silver halide photographic light-sensitive element as claimed in claim 15, wherein said element is a color reversal film.

30. The silver halide photographic light-sensitive element as claimed in claim 15, wherein said element is a color negative film.

* * * * *